US009309829B2

(12) United States Patent
Radeczky et al.

(10) Patent No.: US 9,309,829 B2
(45) Date of Patent: Apr. 12, 2016

(54) METHOD FOR ANALYZING THE EFFICIENCY OF THE HIGH-PRESSURE PUMP OF A FUEL INJECTION SYSTEM

(75) Inventors: Janos Radeczky, Wenzenbach (DE); Hans Riepl, Hemau (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 150 days.

(21) Appl. No.: 14/343,090

(22) PCT Filed: Aug. 30, 2012

(86) PCT No.: PCT/EP2012/066831
§ 371 (c)(1),
(2), (4) Date: Mar. 6, 2014

(87) PCT Pub. No.: WO2013/034479
PCT Pub. Date: Mar. 14, 2013

(65) Prior Publication Data

US 2014/0222312 A1 Aug. 7, 2014

(30) Foreign Application Priority Data

Sep. 9, 2011 (DE) ..... 10 2011 082 459

(51) Int. Cl.
*F02M 65/00* (2006.01)
*F02D 41/40* (2006.01)
(Continued)

(52) U.S. Cl.
CPC ..... *F02D 41/40* (2013.01); *F02D 41/3836* (2013.01); *F02M 65/003* (2013.01);
(Continued)

(58) Field of Classification Search
CPC ... F02M 65/00; F02M 65/002; F02M 65/003; F02M 2041/224; F02M 2200/0602; F02D 41/221; F02D 2041/1433; F02D 2041/2055; F02D 2041/0604; F02D 41/3845
USPC ..... 123/446, 198 D, 198 DB, 494, 480; 73/114.41–114.43
See application file for complete search history.

(56) References Cited

U.S. PATENT DOCUMENTS 5,445,019 A * 8/1995 Glidewell ..... F02D 41/221 123/387
5,499,538 A * 3/1996 Glidewell ..... F02D 41/221 123/479

(Continued)

FOREIGN PATENT DOCUMENTS

CN 1902496 A 1/2007 ..... C07K 17/14
DE 19950222 A1 4/2001 ..... F02D 41/22

(Continued)

OTHER PUBLICATIONS

International Search Report and Written Opinion, Application No. PCT/EP2012/066831, 13 pages, Nov. 30, 2012.

(Continued)

*Primary Examiner* — Thomas Moulis
(74) *Attorney, Agent, or Firm* — Slayden Grubert Beard PLLC

(57) ABSTRACT

A method for analyzing the efficiency of a high-pressure pump of a fuel injection system includes analyzing the efficiency of the high-pressure pump with respect to individual pumping strokes of the high-pressure pump, detecting and analyzing the pressure build-up and the pressure drop for the individual pumping strokes, and drawing conclusions about the state of individual components of the high-pressure pump from the analysis of the pressure build-up or the pressure drop.

12 Claims, 4 Drawing Sheets

(51) Int. Cl.
*F02D 41/38* (2006.01)
*F02D 41/22* (2006.01)

(52) U.S. Cl.
CPC ..... *F02M65/006* (2013.01); *F02D 41/3845* (2013.01); *F02D 2041/224* (2013.01); *F02D 2200/0602* (2013.01)

(56) References Cited

U.S. PATENT DOCUMENTS

| | | | | |
|---|---|---|---|---|
| 5,708,202 | A | 1/1998 | Augustin et al. | 73/114.43 |
| 5,715,786 | A * | 2/1998 | Seiberth | F02B 77/088 123/198 D |
| 6,053,147 | A * | 4/2000 | Hemmerlein | F02D 41/222 123/198 D |
| 6,076,504 | A * | 6/2000 | Stavnheim | F02D 41/221 123/198 D |
| 6,293,251 | B1 * | 9/2001 | Hemmerlein | F02D 41/222 123/357 |
| 6,840,222 | B2 | 1/2005 | Schilling et al. | 123/458 |
| 6,901,791 | B1 * | 6/2005 | Frenz | F02D 41/221 73/114.41 |
| 7,139,657 | B2 | 11/2006 | Bouchain et al. | 701/104 |
| 7,270,115 | B2 * | 9/2007 | Dolker | F02D 41/3845 123/447 |
| 7,810,386 | B2 * | 10/2010 | Kraemer | F02D 41/222 73/114.43 |
| 7,950,371 | B2 * | 5/2011 | Cinpinski | F02D 41/221 123/446 |
| 8,499,616 | B2 * | 8/2013 | Stoner | F02D 41/22 73/40 |
| 8,573,185 | B2 * | 11/2013 | Miura | F02D 41/22 123/198 D |
| 8,881,707 | B2 * | 11/2014 | Katsurahara | F02D 41/221 123/198 D |
| 2007/0298432 | A1 | 12/2007 | Anderson et al. | 435/7.1 |

FOREIGN PATENT DOCUMENTS

| | | | | |
|---|---|---|---|---|
| DE | 19946506 | C1 | 7/2001 | F02D 41/22 |
| DE | 10036772 | C2 | 2/2003 | F02D 41/22 |
| EP | 1570165 | B1 | 7/2006 | F02D 41/20 |
| WO | 01/83971 | A1 | 11/2001 | F02D 41/22 |
| WO | 2013/034479 | A1 | 3/2013 | F02D 41/38 |

OTHER PUBLICATIONS

Chinese Office Action, Application No. 201280043800.0, 11 pages, Aug. 27, 2015.

* cited by examiner

METHOD FOR ANALYZING THE EFFICIENCY OF THE HIGH-PRESSURE PUMP OF A FUEL INJECTION SYSTEM

CROSS-REFERENCE TO RELATED APPLICATIONS

This application is a U.S. National Stage Application of International Application No. PCT/EP2012/066831 filed Aug. 30, 2012, which designates the United States of America, and claims priority to DE Application No. 10 2011 082 459.6 filed Sep. 9, 2011, the contents of which are hereby incorporated by reference in their entirety.

TECHNICAL FIELD

This disclosure relates to a method for analyzing the efficiency of the high-pressure pump of a fuel injection system.

BACKGROUND

In modern motor vehicles, fuel injection systems are used which make a great contribution to meeting challenging customer and legal requirements with regard to fuel consumption and emissions of undesirable pollutants. Modern motor vehicles of this type have, for example, compression-ignition internal combustion engines which operate using a common rail diesel injection system.

Said fuel injection systems have, inter alia, a high-pressure pump for pressurizing supplied fuel to a high pressure and forwarding it to a high-pressure system of the respective motor vehicle. A high-pressure accumulator which is also called a rail belongs, inter alia, to said high-pressure system. From there, the highly pressurized fuel is injected by injectors into the combustion chambers of the respective internal combustion engine.

During the driving operation, the high-pressure pump of a fuel injection system is subject to high mechanical loads which over time lead to increasing wear of the high-pressure pump. Said increasing wear can lead to a reduction in the power output or even to a failure of the high-pressure pump. A failure of the high-pressure pump during the driving operation is associated with a breakdown of the vehicle.

Wear recognition of the high-pressure pump of a fuel injection system is not possible by means of known diagnosis systems. Known diagnosis systems recognize merely that there is an error in the fuel injection system, without it being possible, however, to identify the cause of the error. This often leads to components of the fuel injection system being replaced purely out of suspicion and unnecessarily in the workshop, which components are not responsible at all for the faults which have occurred.

SUMMARY

One embodiment provides a method for analyzing the efficiency of the high-pressure pump of a fuel injection system, in which method an analysis of the efficiency of the high-pressure pump is performed which is related to individual pump strokes of the high-pressure pump, in each case the pressure build-up and the pressure dissipation are detected and analyzed for the individual pump strokes, and conclusions about the state of individual components of the high-pressure pump are drawn from the analysis of the pressure build-up or the pressure dissipation.

In a further embodiment, the pressure build-up which occurs during a pump stroke is analyzed for an instantaneously prevailing duty point, and conclusions about the functional capability of an inlet valve of the high-pressure pump are drawn from the analysis of the pressure build-up.

In a further embodiment, in each case one reference profile for the pressure build-up is defined for a multiplicity of duty points, a comparison of the reference profile with a pressure build-up profile which is determined from measured pressure values is performed, the inlet valve is recognized as being faulty in the case of a determination of an impermissibly large deviation of the determined pressure build-up profile from the reference profile, and the inlet valve is recognized as being free of faults in the case of a determination of a permissible deviation of the determined pressure build-up profile from the reference profile.

In a further embodiment, the pressure build-up which occurs during a pump stroke is analyzed for a plurality of duty points with a different pump stroke frequency, and conclusions about the presence of a leak between a plunger of a cylinder of the high-pressure pump and an associated cylinder liner are drawn from said analysis.

In a further embodiment, the pressure dissipation which occurs after a pump stroke is analyzed, and conclusions about the functional capability of an outlet valve of the high-pressure pump are drawn from the analysis of the pressure dissipation.

In a further embodiment, a reference profile is defined for the pressure dissipation, a comparison of the reference profile with a pressure dissipation profile which is determined from measured pressure values is performed, the outlet valve is recognized as being faulty in the case of a determination of an impermissibly large deviation of the determined pressure dissipation profile from the reference profile, and the outlet valve is recognized as being free of faults in the case of a determination of a permissible deviation of the determined pressure dissipation profile from the reference profile.

In a further embodiment, the analysis is performed individually for each cylinder of the high-pressure pump, and conclusions about the functional capability of the components of the respective cylinder are drawn from the analysis.

In a further embodiment, conclusions about the functional capability of the high-pressure pump in its entirety are drawn from the analysis for each cylinder of the high-pressure pump.

In a further embodiment, the method is performed during the normal driving operation of a motor vehicle.

In a further embodiment, the data which are determined during the normal driving operation and relate to the functional capability of the components of the high-pressure pump are stored in a memory in a non-volatile manner.

In a further embodiment, advanced wear of one or more components of the high-pressure pump is recognized from the data which relate to the functional capability of the components of the high-pressure pump during the driving operation, and lowering of the maximum permissible pressure in the fuel injection system is performed as a reaction thereto.

BRIEF DESCRIPTION OF THE DRAWINGS

Example embodiments are discussed below with reference to the figures, in which.

DETAILED DESCRIPTION

Embodiments of the present invention provide an improved method for localizing faults that occur in a fuel injection system.

Some embodiments provide a method for analyzing the efficiency of the high-pressure pump of a fuel injection system in which an analysis of the efficiency of the high-pressure pump is performed which is related to individual pump strokes, in each case the pressure build-up and the pressure dissipation are analyzed for the individual pump strokes, and conclusions about the state of individual components of the high-pressure pump are drawn from the analysis of the pressure build-up and the pressure dissipation.

In some embodiments, an analysis of the efficiency of the high-pressure pump of a fuel injection system is performed, an analysis of the efficiency of the high-pressure pump being performed which is related to individual pump strokes of the high-pressure pump, in each case the pressure build-up and the pressure dissipation being detected and analyzed for the individual pump strokes, and conclusions about the state of individual components of the high-pressure pump being drawn from the analysis of the pressure build-up or the pressure dissipation.

Figure 1:
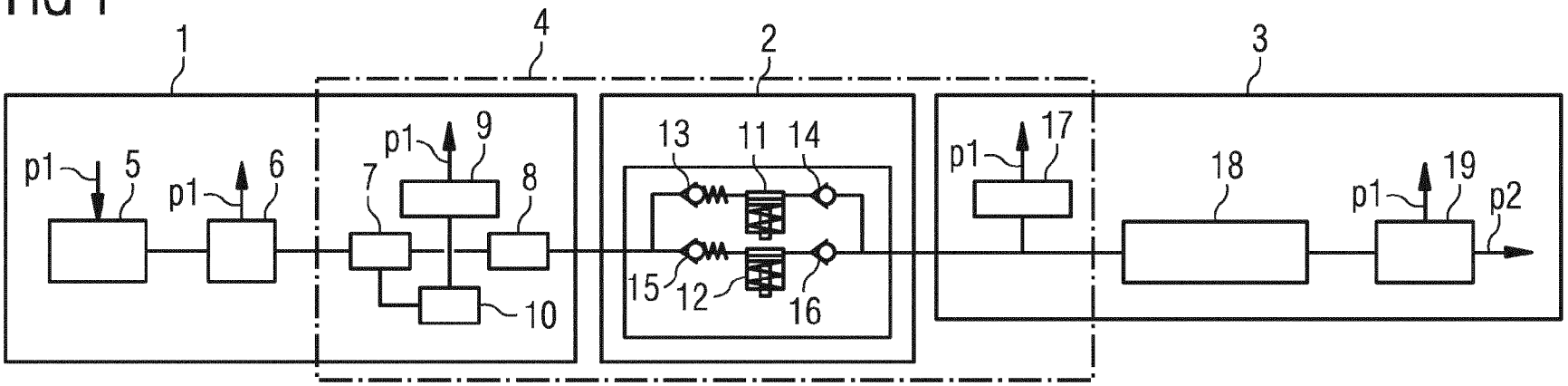
FIG. 1 shows a block diagram of the constituent parts of an example fuel injection system.

FIG. 1 shows a block diagram of the constituent parts of a fuel injection system relevant to understanding the invention.

The block diagram which is shown in FIG. 1 has a fuel feed system 1, a high-pressure fuel pump 2 and a high-pressure system 3. The block 4 which is provided with a dashed border is a diesel common rail pump, to which, inter alia, an internal transfer pump 7 and the high-pressure fuel pump 2 belong. A fuel tank 5, a fuel filter 6, the abovementioned internal transfer pump 7, a volumetric flow control valve 8, an overflow valve 9 and a pressure limiting valve 10 belong to the fuel feed system 1. The arrows which are labeled by the characters p1 are a constituent part of a pump lubrication and fuel return circuit.

The high-pressure fuel pump 2 has a parallel circuit of two cylinders 11, 12, the first cylinder 11 having an inlet valve and an outlet valve 14 and the second cylinder 12 being provided with an inlet valve 15 and an outlet valve 16. Each of the cylinders has a plunger which, during operation of the cylinder, is moved along a cylinder liner.

This movement is in each case assigned a swept volume or displacement volume. Pressure losses which will be called blowby in the following text occur during the movement of the plunger along the cylinder liner.

The high-pressure system 3 comprises a pressure limiting valve 17, the rail 18 and injectors 19. Fuel is injected into the combustion chambers of the internal combustion engine by said injectors 19 via feed lines p2.

The apparatus which is shown operates as follows:

Fuel which is provided from the fuel tank 5 is fed via the fuel filter 6 to the internal transfer pump 7. The fuel at a low pressure which is available at the outlet of the transfer pump 7 is fed via the volumetric flow control valve 8 to the high-pressure fuel pump and is pressurized to a high pressure there by means of the cylinders 11 and 12. The fuel at a high pressure passes via the outlet valves 14 and 16 to the high-pressure system 3 and, in the latter, to the rail 18. From there, the highly pressurized fuel is injected by the injectors 19 into the combustion chambers of the internal combustion engine.

During engine operation, the high-pressure pump 2 is subject to high mechanical loads and therefore to increasing wear of its components. Said wear can lead over the service life of the high-pressure pump to a power output reduction or even to a failure of the high-pressure pump. A failure of the high-pressure pump is necessarily associated with a breakdown of the respective vehicle. The disclosed method makes it possible to recognize the wear state of the components of the high-pressure pump and therefore also to recognize an impending failure of the high-pressure pump. The operation of the entire fuel injection system can be stabilized by way of this recognition. In many cases, the cause of a fault which occurs in the fuel injection system can also be localized to a certain component of the fuel injection system.

In particular, the disclosed method allows individual components of the high-pressure pump of the fuel injection system to be detected as being faulty or free of faults. If one or more components of the high-pressure pump is or are recognized as being faulty or as being threatened by an impending failure, a remedy can be provided in a targeted manner by targeted repair of said components or possibly necessary replacement of said components or the entire high-pressure pump.

For this purpose, an efficiency analysis of the high-pressure pump is performed. Said efficiency analysis takes place in relation to a single pump stroke and also taking a plurality of pump strokes into consideration. In order for it to be possible to perform an efficiency analysis which is related to the individual components of the high-pressure pump, said efficiency analysis takes place in a plurality of part regions and/or steps.

In one of said steps, an efficiency analysis takes place, in which the outlet valves 14 and 16 of the pump cylinders 11 and 12 are tested for their functional capability. For this purpose, the pressure drop is detected and analyzed in each case after a pump stroke. If said pressure drop is greater than an associated threshold value, the respective outlet valve is recognized as being faulty. If, in contrast, said pressure drop is smaller than the associated threshold value, the respective outlet valve is recognized as being free of faults. As a result, said step makes selective identification of a damaged outlet valve possible. By way of this possibility of analyzing the outlet valves of the pump cylinders individually, conclusions can be drawn as a result about the functional capability of the individual cylinders of the high-pressure pump, it also being possible for the sum of the results to be used for an evaluation of the entire components.

In a further step, an efficiency analysis takes place, in which the inlet valves 13 and 15 of the cylinders 11 and 12 are tested for their functional capability, and in which, furthermore, the loss in efficiency which is caused by a blowby between the respective pump piston and the respective cylinder liner is determined. For this purpose, in each case the pressure per pump stroke is detected and analyzed. This takes place in each case in a manner which is related to the duty point. For this purpose, a reference value and a permissible deviation are predefined in each case for a multiplicity of duty points. If the pressure build-up at the respective duty point is in the tolerated range, the high-pressure pump is found to be in order with regard to the respective inlet valve. A corresponding check at a plurality of duty points with different pump stroke frequencies takes place in order to determine the pressure drop which is caused by blowby.

By way of the above-described functional evaluation and combined observation of the individual components of the high-pressure pump, said high-pressure pump can be recognized as being defective or subject to great wear and, for example, can be replaced or repaired during customer service work, before the respective vehicle breaks down on account of an efficiency-related malfunction of the high-pressure pump.

Since the above-described efficiency analysis can be performed during the normal driving operation of the vehicle, there is advantageously the possibility of lowering the maximum permissible pressure in the fuel injection system if a failure of the high-pressure pump which is imminent in the foreseeable future is recognized, in order for it to be possible to realize the full load quantity and in order for it to be possible to maintain the functional capability of the fuel injection system until the next workshop visit. Said lowering of the maximum permissible pressure in the fuel injection system takes place, in particular, at duty points which are not relevant for the exhaust gas in a high-pressure pump which has been recognized as being marginal in volumetric terms.

Figure 2:
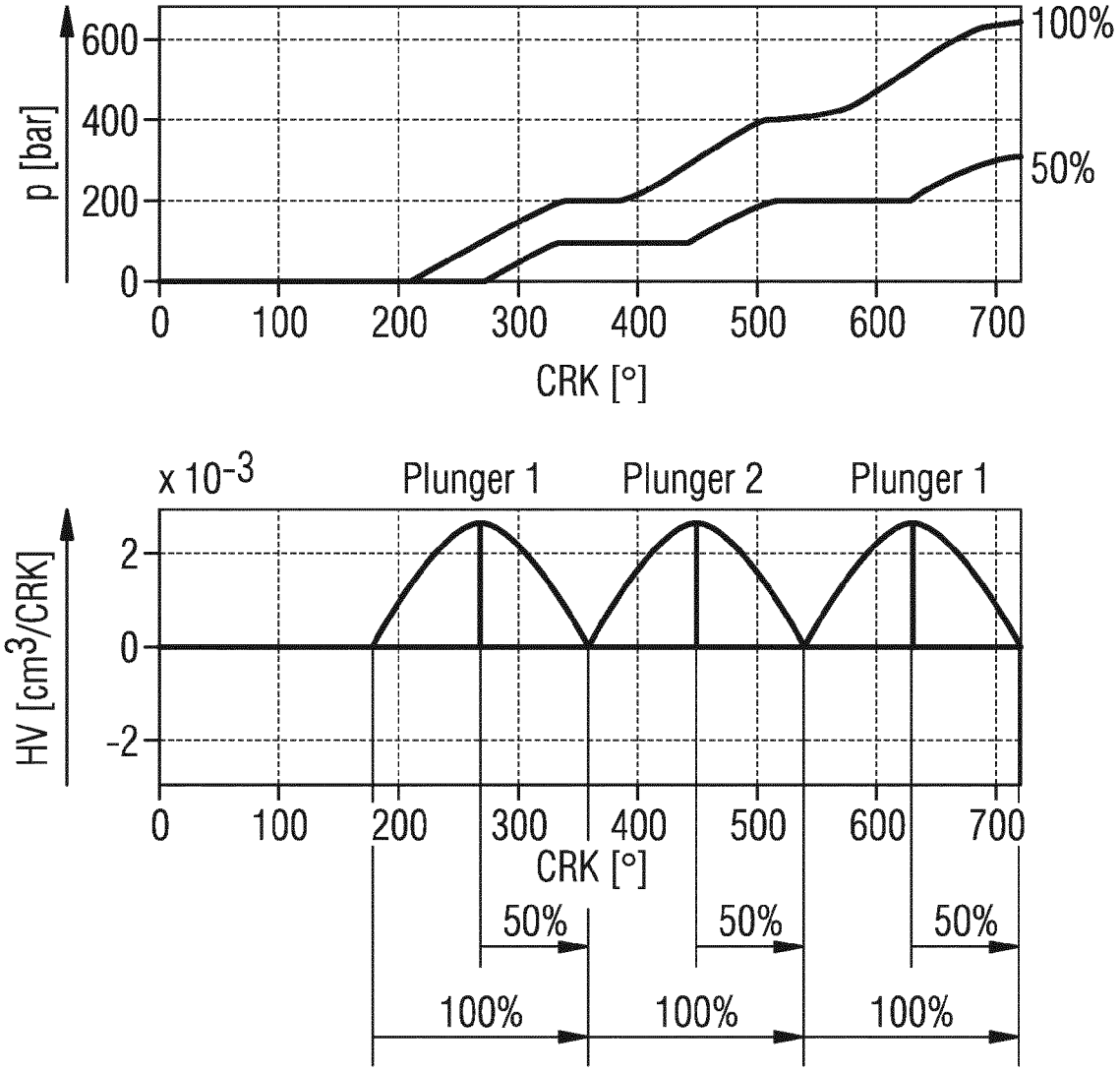
FIG. 2 shows diagrams for illustrating the pressure build-up in the cylinders of a high-pressure pump.

FIG. 2 shows diagrams for illustrating the pressure build-up in the cylinders of a high-pressure pump.

In the upper diagram, the crankshaft angle CRK is plotted along the abscissa and the pressure p is plotted along the ordinate. The upper curve of the upper diagram shows the theoretical pressure build-up (efficiency 100%) in the case of a flow rate of the high-pressure pump of 100%. In the lower curve of the upper diagram, the theoretical pressure build-up (efficiency 100%) is illustrated in the case of a flow rate of the high-pressure pump of 50%.

In the lower diagram of FIG. 2, the crankshaft angle CRK is plotted along the abscissa and the swept volume or displacement volume HV of the cylinders of the high-pressure pump is plotted along the ordinate, the flow rate 50% or 100% of the high-pressure pump being symbolized by respective arrows in the diagram.

Figure 3:
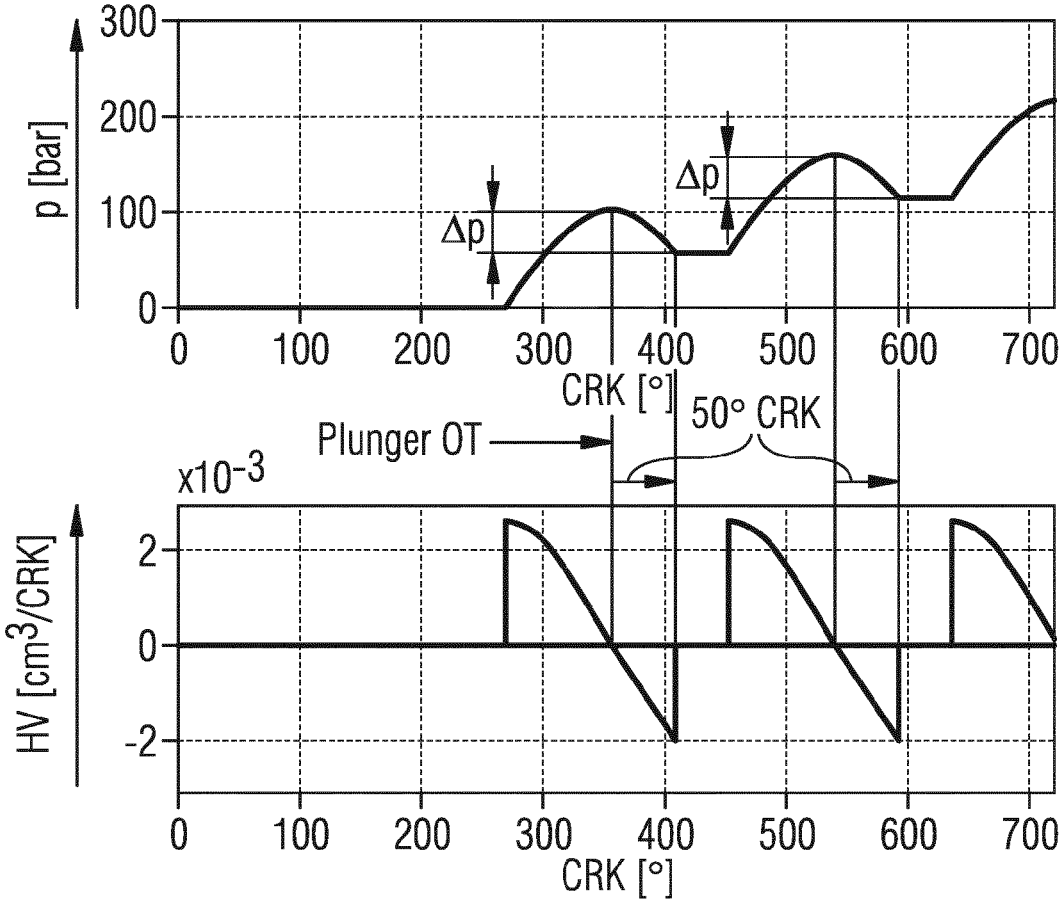
FIG. 3 shows diagrams for illustrating the influence of the closing point of the outlet valves of a high-pressure pump on the pressure characteristics.

FIG. 3 shows diagrams for illustrating the influence of the closing point of the outlet valves of a high-pressure pump on the pressure characteristics of the high-pressure pump.

Here, in the upper diagram, the crankshaft angle CRK is plotted along the abscissa and the fuel pressure p is plotted along the ordinate. The curve which is shown in the upper diagram illustrates the pressure loss $\Delta p$ which occurs in the fuel injection system and occurs when a crankshaft closing angle which lies at 50° is present.

In the lower diagram, the crankshaft angle CRK is plotted along the abscissa and the swept volume or displacement volume HV of the cylinders of the high-pressure pump is plotted along the ordinate, the presence of a crankshaft closing angle of 50° once again being illustrated by the arrows in the diagram. Furthermore, the top dead center of the plunger is specified in FIG. 3.

Figure 4:
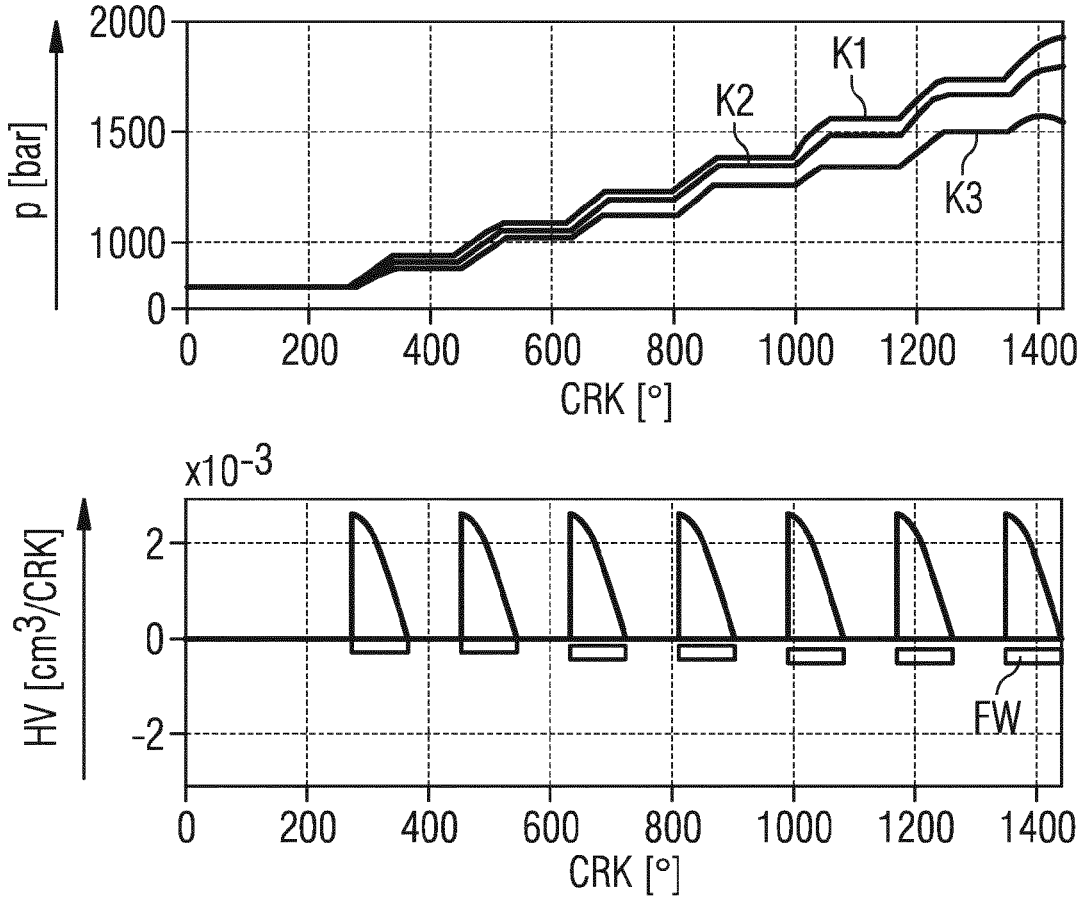
FIG. 4 shows diagrams for illustrating the influence of the rotational speed of the crankshaft on the pressure characteristics if there is an internal leak in the high-pressure pump.

FIG. 4 shows diagrams for illustrating the influence of the rotational speed of the crankshaft on the pressure characteristics if an internal leak of the high-pressure pump is present.

Here, in the upper diagram, the crankshaft angle CRK is plotted along the abscissa and the fuel pressure p is plotted along the ordinate. The curve K1 which is shown in the upper diagram illustrates the pressure build-up in the case of a 50% flow rate of the high-pressure pump without the presence of a pump leak at 1000 rpm and 3000 rpm. The curve K2 illustrates the pressure build-up in the case of a 50% flow rate of the high-pressure pump in the presence of a pump leak at 3000 rpm. The curve K3 illustrates the pressure build-up in the case of a 50% flow rate of the high-pressure pump in the presence of a pump leak at 1000 rpm.

In the lower diagram, the crankshaft angle CRK is plotted along the abscissa and the swept volume or displacement volume HV of the cylinders of the high-pressure pump is plotted along the ordinate. It can be seen from this diagram that the flow FW which is caused by a pump leak becomes greater with an increasing crankshaft angle or an increasing rotational speed.

The accuracy of the above-described efficiency analysis of the high-pressure pump is influenced by various factors. It is dependent firstly on the accuracy of the rail pressure sensor which is used during the measurement. The accuracy of said sensor lies at ±1%. In particular, if pressure differences are considered, a sufficient accuracy of the pressure sensor can therefore be assumed. If desired, the accuracy of said sensor can be checked by way of a plausibility check.

A further factor which influences the accuracy of the efficiency analysis of the high-pressure pump is the modulus of elasticity. In the case of a constant system volume, temperature has the greatest influence on the modulus of elasticity. The temperature which is present in the rail is modeled in a manner which is based on the measured temperature value in the pump preliminary operation or in the injector return and is available with high accuracy in the system.

Furthermore, the present permanent leak of the system influences the accuracy of the efficiency analysis of the high-pressure pump. In order for it to be possible to determine said permanent leak of the system, pump delivery is prevented by closure of the volumetric flow valve 8 for a few working cycles and the pressure drop gradient over time is stored in a memory of the system as permanent leak of the system over pressure and temperature. This stored variable can be used during the determination of the actual pressure build-up as a correction value.

The volumetric efficiency of the high-pressure pump is influenced substantially by two factors:

The first factor is the effective delivery duration. Depending on the embodiment of the pump, the closing point of the outlet valves of the pump can vary. This can lead to fuel flowing back from the high-pressure system into the pump after the top dead center of the plunger of the pump is reached. The closing angle of the outlet valves of the high-pressure pump is determined by the pressure profile being detected and the detected pressure profile being corrected with the already determined permanent leak. The profile which is obtained in this way is derived. If the derivation is greater than zero, the pump is delivering. If the derivation is equal to 0, the top dead center of the piston of the plunger is present. If the derivation is less than zero, pressure is flowing back from the system into the pump. The outlet valve is closed at the moment at which the derivation becomes zero again. This crank angle value in relation to the top dead center of the plunger is applied as correction during the calculation of the effective flow rate.

The volumetric efficiency of the high-pressure pump also depends on the tolerances and on the wear of the components of the high-pressure pump. Thus, as has already been described above, there are losses as a result of the blowby between the plunger piston and the cylinder liner or as a result of a defective inlet valve. This pressure loss can be determined by the pressure build-up being detected at various rotational speeds. After corrections which are to be attributed to the permanent leak and the closing point tolerances of the outlet valves are taken into consideration, the result is a different gradient in the pressure build-up over the crankshaft angle. The reason for this is that the pressure build-up takes longer if a low rotational speed is present, and that more time for gap losses is available during the pump delivery.

As can be seen from the above comments, system-specific parameters have been used in the described analysis of the pump efficiency, in order to perform targeted measurements during normal engine operation, and the data which are obtained by evaluation of the measured results are used as verifying variables for the determination of the functional capability and the wear state of the high-pressure pump. By way of this functional evaluation of the detected measured data, a forward-looking evaluation of the high-pressure pump can be performed and a reduction in power output on account of pump wear and a breakdown of the vehicle can be avoided.

Since the described method for analyzing the efficiency of the high-pressure pump can be performed during normal vehicle operation, it advantageously covers the entire engine operating range spectrum. This makes a comprehensive assessment of the state of the high-pressure pump possible. Since faults which occur are detected during normal driving operation, said faults can be assigned to a defined engine operation state and this assignment can be stored together with further fault data in the vehicle. This has the advantage that the load point, at which the malfunction occurred, is already known during a following workshop visit.

The described method for analyzing the efficiency of the high-pressure pump is preferably performed in engine overrun phases, since an undesired influence of disturbance variables on the method can be ruled out largely in said engine overrun phases.

The described method can advantageously be used together with a further functionality, for example MFMA (Minimal Fuel Mass Adaption), as is described in EP 1 570 165 B1, for example. A pressure increase during overrun operation is used here.

The invention claimed is:

1. A method for analyzing the efficiency of the high-pressure pump of a fuel injection system, comprising:

analyzing an efficiency of the high-pressure pump related to individual pump strokes of the high-pressure pump, wherein the analysis includes:

detecting and analyzing a pressure build-up or a pressure dissipation for each individual pump stroke, and determining a state of individual components of the high-pressure pump based on the analysis of the pressure build-up or the pressure dissipation for each individual pump stroke.

2. The method of claim 1, comprising:

analyzing the pressure build-up during a pump stroke to determine an instantaneously prevailing duty point, and determining a functional capability of an inlet valve of the high-pressure pump based on the analysis of the pressure build-up.

3. The method of claim 2, comprising:

defining a reference profile for the pressure build-up for a multiplicity of duty points, comparing the reference profile with a pressure build-up profile determined from measured pressure values, identifying the inlet valve as being faulty in response to a determination of deviation of the determined pressure build-up profile from the reference profile greater than a threshold value, and identifying the inlet valve as being free of faults in response to a determination of a deviation of the determined pressure build-up profile from the reference profile less than the threshold value.

4. The method of claim 1, comprising:

analyzing the pressure build-up during a pump stroke for a plurality of duty points with a different pump stroke frequency, and determining a presence of a leak between a plunger of a cylinder of the high-pressure pump and an associated cylinder liner based on said analysis.

5. The method of claim 1, comprising:

analyzing the pressure dissipation after a pump stroke, and determining a functional capability of an outlet valve of the high-pressure pump based on the analysis of the pressure dissipation.

6. The method of claim 5, comprising:

defining a reference profile for the pressure dissipation, comparing the reference profile with a pressure dissipation profile determined from measured pressure values, identifying the outlet valve as being faulty in response to a determination of a deviation of the determined pressure dissipation profile from the reference profile greater than a threshold value, and identifying the outlet valve as being free of faults in response to a determination of a deviation of the determined pressure dissipation profile from the reference profile less than the threshold value.

7. The method of claim 1, comprising:

analyzing each cylinder of the high-pressure pump individually, and determining a functional capability of components of each respective cylinder based on the analysis.

8. The method of claim 7, comprising determining a functional capability of the high-pressure pump in its entirety based on the analysis of each cylinder of the high-pressure pump.

9. The method of claim 1, comprising performing the method during the normal driving operation of a motor vehicle.

10. The method of claim 9, comprising storing data determined during the normal driving operation and relate to the functional capability of the components of the high-pressure pump in a memory in a non-volatile manner.

11. The method of claim 9, comprising:

identifying advanced wear of one or more components of the high-pressure pump based on data relating to the functional capability of the components of the high-pressure pump during the driving operation, and lowering a maximum permissible pressure in the fuel injection system in response to identifying advanced wear.

12. The method according to claim 1, further comprising detecting and analyzing both a pressure build-up and a pressure dissipation for each individual pump stroke, and determining a state of individual components of the high-pressure pump based on the analysis of the pressure build-up and the pressure dissipation for each individual pump stroke.

* * * * *